US007762452B2

(12) United States Patent
Androsyuk et al.

(10) Patent No.: US 7,762,452 B2
(45) Date of Patent: Jul. 27, 2010

(54) LIGHTED BEZEL

(75) Inventors: Sergiy Androsyuk, Toronto (CA); Dmitro Baydin, Etobicoke (CA); Yuri Rusakov, Etobicoke (CA); Oleksandr Lukonin, Thornhill (CA)

(73) Assignee: Crane Canada Co., Concord, ON (CA)

( * ) Notice: Subject to any disclaimer, the term of this patent is extended or adjusted under 35 U.S.C. 154(b) by 237 days.

(21) Appl. No.: 11/585,975

(22) Filed: Oct. 25, 2006

(65) Prior Publication Data

US 2008/0099547 A1 May 1, 2008

(51) Int. Cl.
*G07B 15/00* (2006.01)

(52) U.S. Cl. ..... 232/13; 194/350; 362/154; 362/812; 40/442

(58) Field of Classification Search ..... 232/15, 232/16, 1 D, 13; 40/452, 463, 550, 553, 40/442; 362/154, 252, 311.02, 800, 812, 362/253; 194/344, 350
See application file for complete search history.

(56) References Cited

U.S. PATENT DOCUMENTS

| | | | | |
|---|---|---|---|---|
| 4,924,363 | A * | 5/1990 | Kornelson | 362/125 |
| 5,113,990 | A * | 5/1992 | Gabrius et al. | 194/206 |
| 5,222,624 | A * | 6/1993 | Burr | 221/1 |
| 5,791,449 | A | 8/1998 | Deaville et al. | |
| 6,435,329 | B1 * | 8/2002 | Amari et al. | 194/206 |
| 6,651,365 | B1 * | 11/2003 | Wainwright | 40/452 |
| 6,712,191 | B2 * | 3/2004 | Hand | 194/344 |
| 7,086,751 | B2 * | 8/2006 | Clark | 362/154 |
| 2002/0125627 | A1 | 9/2002 | Hand | |
| 2004/0129529 | A1 | 7/2004 | Saltsov et al. | |
| 2006/0113162 | A1 | 6/2006 | Ottesen et al. | |

* cited by examiner

*Primary Examiner*—William L. Miller

(57) ABSTRACT

A validator with a lighted bezel having a series of spaced lighted segments to one side of a banknote slot provides functional information and also defines an attract mode for potential purchasers. The validator is designed to enhance and to complement the traditional advertising used by the associated equipment or systems such as a vending machine. Preferably, a pulsing light sequence for turning lighted bar segments of different lengths is used.

19 Claims, 7 Drawing Sheets

LIGHTED BEZEL

FIELD OF THE INVENTION

The present invention relates to vending machines, and in particular, banknote validators for use in association with vending machines.

BACKGROUND OF THE INVENTION

Banknote validators are now commonly used in automated vending machines and point of sale systems. Typically, these are unattended locations and a potential purchaser visually locates a vending machine and approaches it.

The banknote validator includes a bezel that typically extends through a port in a door or wall of a vending machine and provides a banknote slot in combination with service or instruction lights for operation of the validator. As can be appreciated, the first step in initiating the purchase of a product from the vending machine is the receipt of a banknote or payment card in the vending machine. Validators have previously used a conservative front face of the bezel that may include one or more lights associated with the bank slot to draw attention to the slot. These lights tend to be on for the majority of the time but the lights may change if certain operating conditions arise during operation of the banknote validator. For example, upon receipt of a banknote, a change in the light condition may occur, or if a jam in the validator occurs during receipt of a banknote, the color of the light may change.

Much in the manner of a video game machine, the present banknote validator bezel has what might be considered an attract mode. The attract mode includes a changing or pulsing light sequence and a patterned layout of lights to encourage or clearly indicate the initial step of inserting a banknote. According to the present invention, the bezel, as well as providing operating instructions, also provides an attract function. This attract mode complements or supplements the advertising provided on the vending machine. This is in contrast to existing bezels where any lights are limited to merely providing instruction functionality and do not have an attract mode to supplement the vending machine or point of sale system.

SUMMARY OF THE INVENTION

In a banknote validator according to the present invention, a bezel is provided having a front face with a banknote slot for receiving banknotes and a plurality of lighted segments positioned to one side of the banknote slot. A circuit is provided for repeatedly turning on and off the lighted segments in a sequence to provide a visual direction towards the banknote slot.

According to an aspect of the invention, the lighted segments are of different lengths and at different spacings from the banknote slot.

According to an aspect of the invention, the lighted segments are at least three lighted segments of different lengths and collective form an inverted V-shaped configuration pointing towards the banknote slot.

In yet a further aspect of the invention, each lighted segment includes a lens and at least one LED provided on the circuit board positioned within the bezel and adjacent to the lens. The lens of each LED defines at least three separate spaced areas of higher illumination within the strip segment.

In yet a further aspect of the invention, each lens is a colored lens.

In yet a further aspect of the invention, a single component forms the lens for each light segment.

In yet a further aspect of the invention, at least three separate spaced areas of higher illumination include at least two bar portions extending across the lighted segment.

In a further aspect of the invention, the lighted segments form three lighted bar portions at different spacings from the banknote slot and the sequence causes lighting of the first bar portion furthest from the banknote slot, followed by lighting of a second bar portion immediately adjacent the first bar portion and closer to the banknote slot, followed by lighting of a third bar portion adjacent to the second bar portion and closest to the banknote slot followed by turning off of the third bar portion, followed by turning off the second bar portion, followed by turning off the third bar portion.

In a different aspect of the invention, the sequence is constantly repeated in an attract mode.

In yet a further aspect of the invention, the sequence has a duration of less than two seconds.

In a preferred aspect of the invention, each step to light or turn off a bar portion has a duration of less than 150 milliseconds.

In yet a further aspect of the invention, the circuit is a circuit board including five aligned LED's positioned to light one bar portion, three aligned LED's positioned to light one of the bar portions, and a single LED for lighting one of the bar portions.

In a further aspect of the invention, each LED includes two LED segments of different colors.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
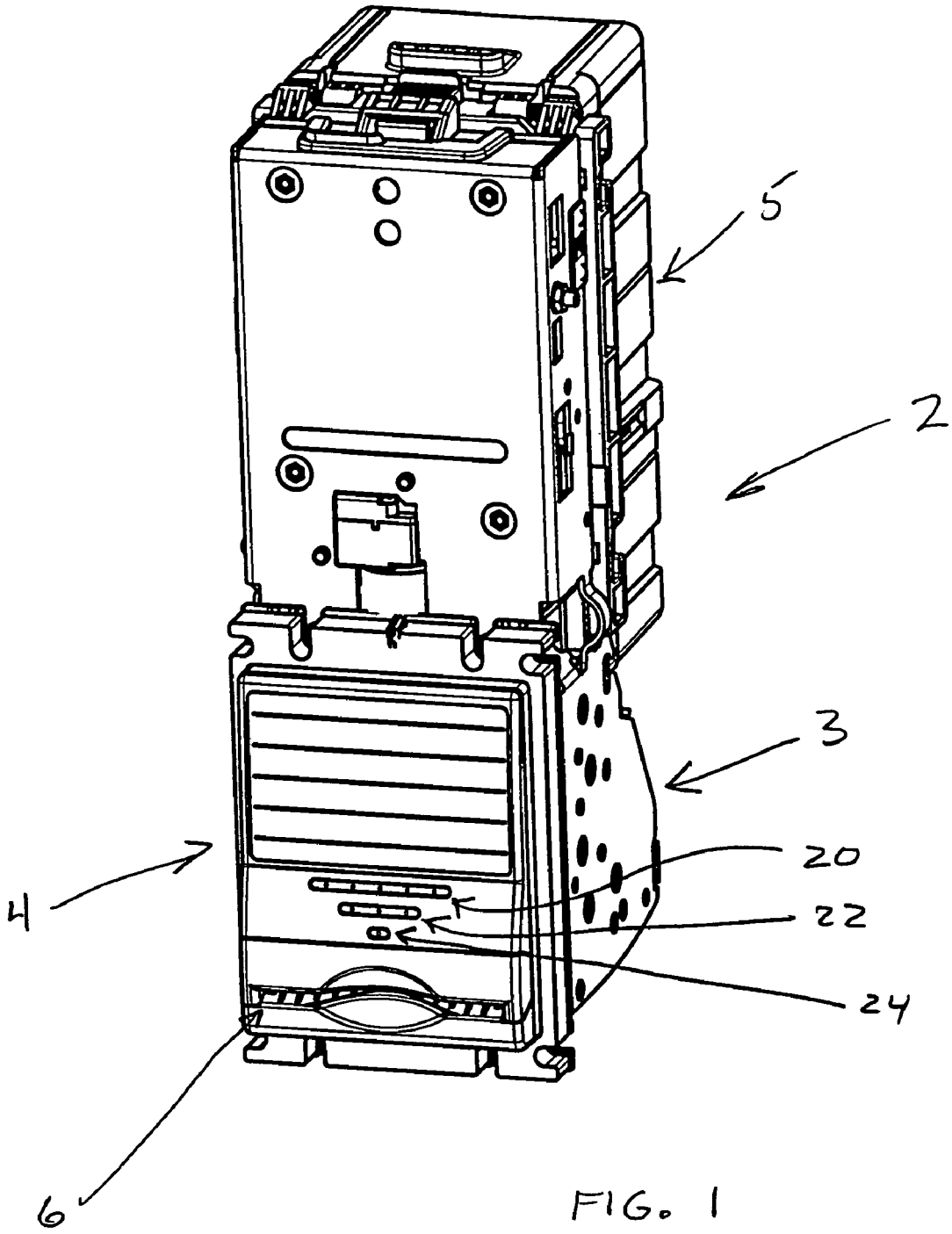
FIG. 1 is a front perspective view of the banknote validator with the bezel.

The banknote validator 2 can take various forms, however, the primary purpose of the validator is to receive banknotes through the banknote slot 6 in the bezel 4. The bezel 4 projects through a port in a vending machine or other point of purchase system and validates the banknote as part of the purchasing sequence. The particular validator shown includes a validating head 3 as well as a banknote cassette 5 for stacking received banknotes and storing the same. The particular validator 2 shown in FIG. 1 is vertically orientated with the banknote cassette provided above the banknote slot, however, it is also common for the banknote validator to have the banknote cassette provided below the validator head 3. In addition, it is common to have validators with an accumulator for temporarily storing banknotes which can be recycled as change.

The validator is described with respect to a banknote slot but this slot could be a card payment slot.

Figure 2:
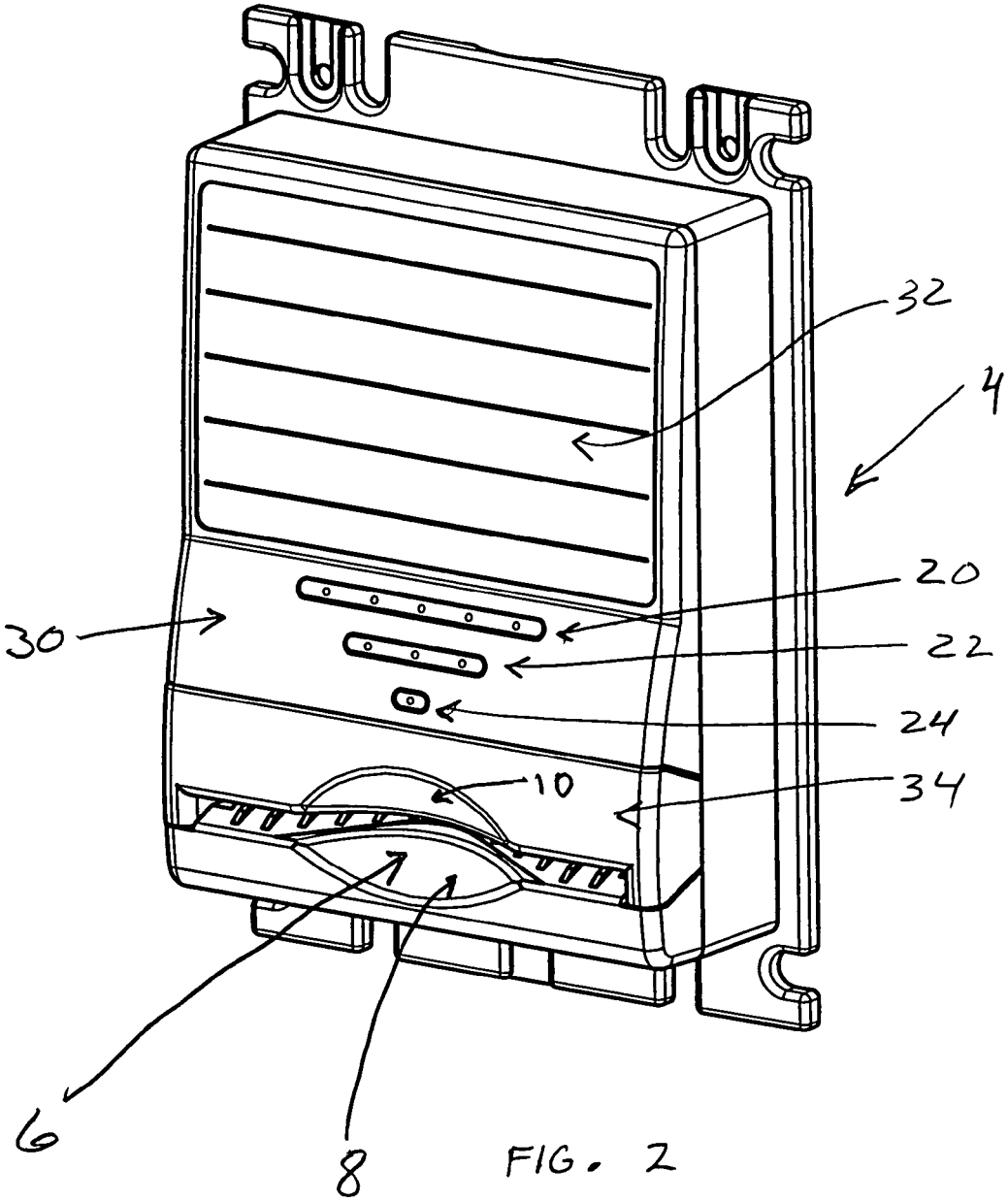
FIG. 2 is a front perspective view of the bezel.

The banknote bezel 4 includes the banknote slot 6 provided in a forwardly extending surface 34 shown in FIG. 2, an angled transition surface 30 which includes slots for receiving the portion of the lens body defining elongated lighted segments 20, 22 and 24 at a different spacing from the banknote slot. The transition surface 30 merges with the planar recessed surface 32.

With the banknote bezel as shown in FIG. 2, the elongate lighted segments 20, 22 and 24, define a V-shaped or arrow shaped pattern pointing towards the banknote slot 6. In particular, this V-shaped configuration points towards the center of the banknote slot 6 which includes the opposed concave recesses 8 and 10 either side of the banknote slot 6. The elongate lighted segments 20, 22 and 24 are spaced apart and preferably parallel to the banknote slot 6. The lighted segments are in the angled transition surface 30 and are not immediately adjacent the banknote slot 6 and are not in the extending surface 34 which defines the banknote slot 6.

In contrast to traditional bezels for banknote validators, a series of lighted segments 20, 22 and 24 are provided and these are electronically controlled to have a particular lighting sequence which is pronounced and is designed to attract and provide a motion effect towards the banknote slot.

It has been known to provide lights immediately adjacent a banknote slot, however, these prior arrangements have been for a functional purpose to identify the banknote slot and the particular operation of the validator. These prior art lights are controlled to remain ON when the validator is not being used to receive a banknote. These previous arrangements have not appreciated the interaction of the banknote validator with the vending or point of sale system. The first step in a successful sale is the feeding of a banknote through the banknote slot 6 and there continues to be some reluctance of purchasers to use standalone point of sale systems.

In FIGS. 3 through 8, a particular lighting sequence for elongate lighted segments 20, 22 and 24 is shown.

Figure 3:
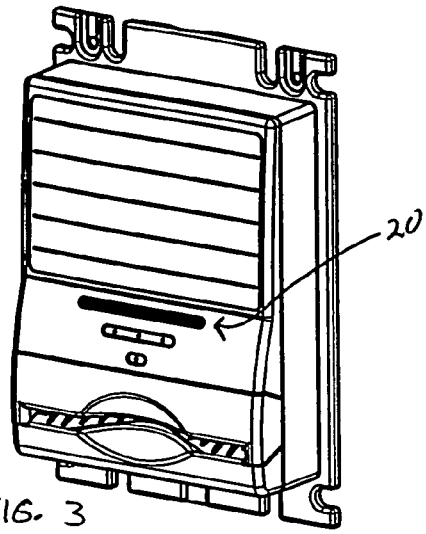
FIGS. 3 through 8 show the banknote bezel and the lighting sequence for the bar segments.
Figure 4:
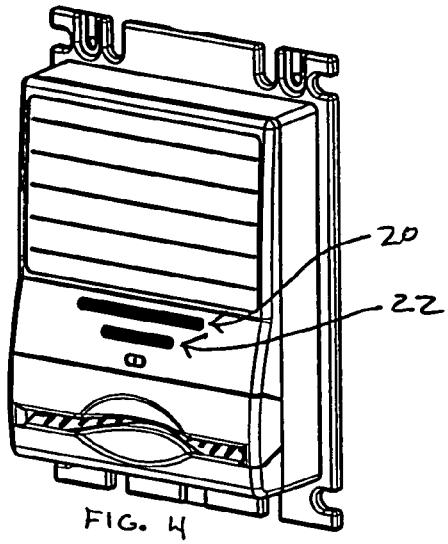

FIG. 3 shows the illumination of lighting segment 20 with the other lighting segments OFF. In FIG. 4, lighting segments 20 and 22 are now illuminated. In FIG. 3, the last lighting segment 24 is illuminated and thus, all lighting segments are now ON.

Figure 5:
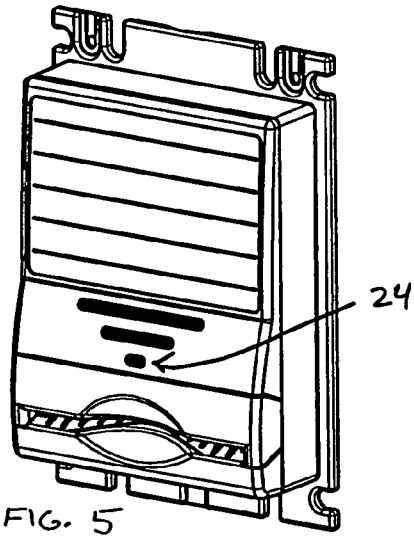
Figure 6:
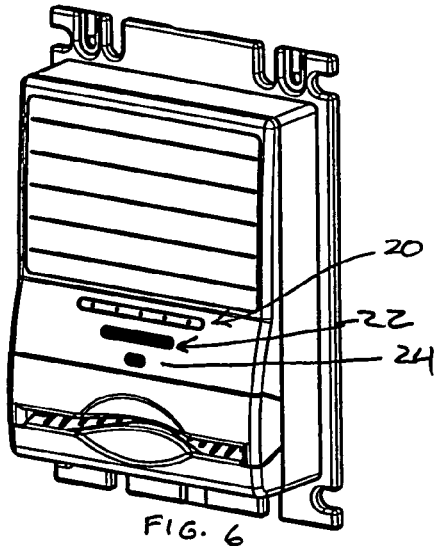

In FIG. 5 it can be seen that lighting segment 20 has now been turned OFF and segments 22 and 24 remain ON.

Figure 7:
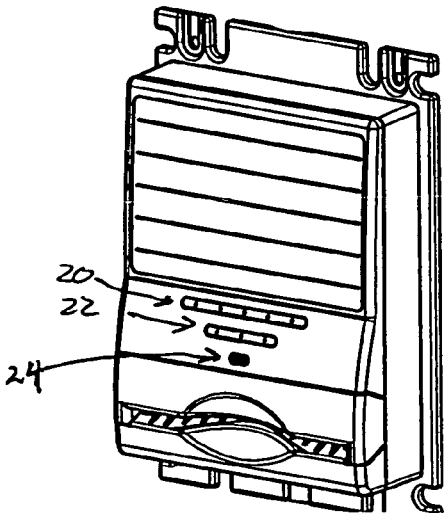

In FIG. 7, lighting segments 20 and 22 are now OFF and only segment 24 is ON.

Figure 8:
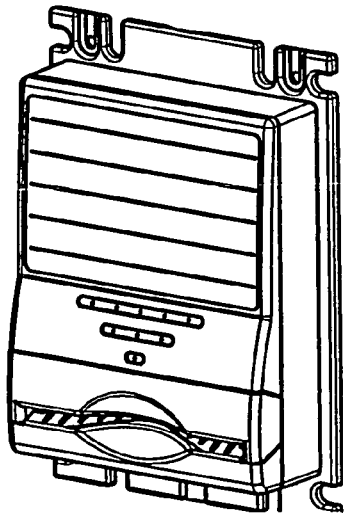

In FIG. 8, all lighting segments have now been turned OFF.

This lighting sequence occurs quite rapidly and the time between the lighting of each segment is less than 200 milliseconds and preferably, less than 150 milliseconds and of equal duration. The total duration of the lighting sequence is preferably less than two seconds. With this particular sequence, the initial lighting of the segments points towards or implies a direction towards the banknote slot 6. The portion of the sequence shown in FIGS. 6 through 8 also implies a direction toward the banknote slot 6. The directional effect is similar to flight simulators and visual information associated with runway approaches generally referred to as a "lit runway effect". In addition, this particular sequence and the timing thereof, are difficult to visually determine but it is also somewhat hypnotic, soothing, or rhythmic. Preferably, these segments produce a blue light and the overall impression is quite distinctive and bold. This is in direct contrast to prior art validators which include lighted segments. This prior art was designed to basically blend with the surrounding equipment. In most cases, the surrounding equipment is a vending machine where the large surface of the vending machine is used for advertising and promotion.

The present bezel acts like a motion beacon and defines a visual attract mode. The lighted bezel not only implies functional, operational information about placing a banknote in the banknote slot to initiate a transaction, but it also attracts a potential purchaser to the vending machine or point of sale system. Therefore the bezel and the lighted sequence thereof defines an attract mode for the point of sale system.

Figure 9:
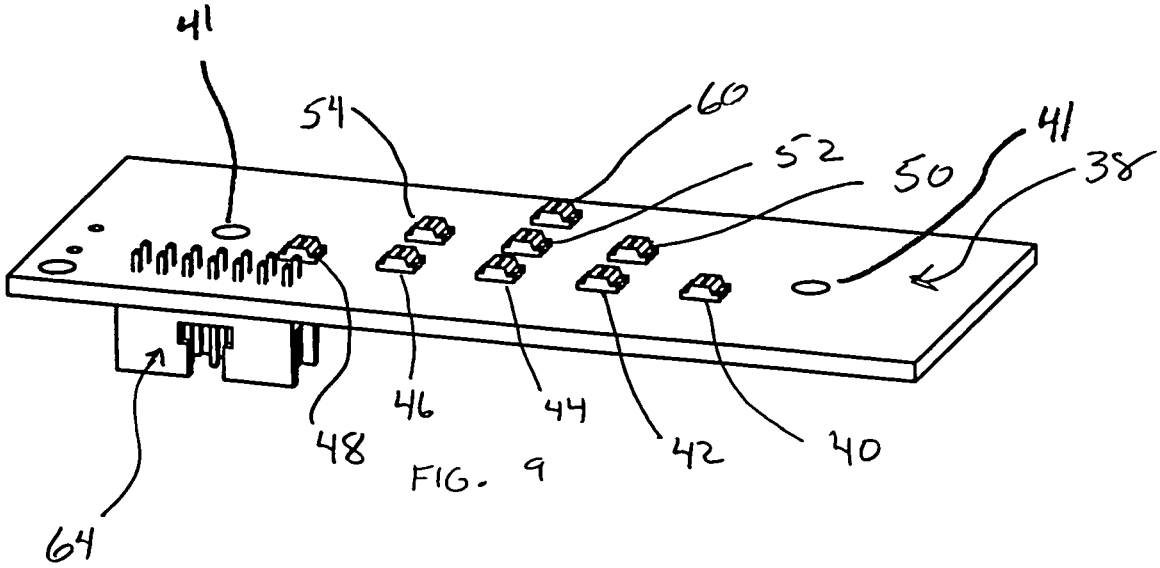
FIG. 9 is a perspective view of the circuit board for the banknote bezel.
Figure 13:
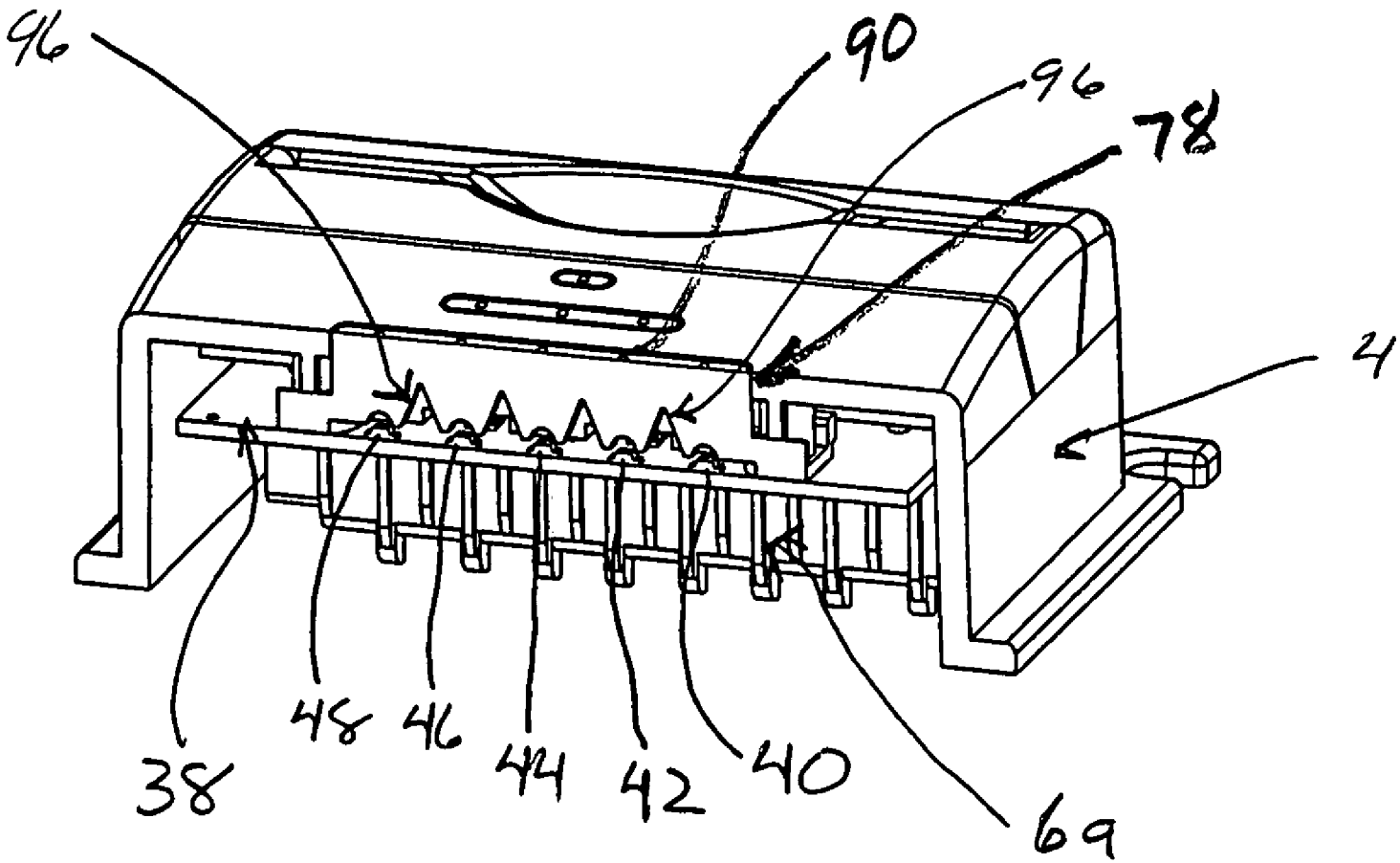
FIG. 13 is a perspective cross section through the bezel and through the largest elongate lens segment showing the relationship of the circuit board, the lens segment and the bezel.

Each bezel includes behind the front face, a lens body 78 which partially projects through the front fact of the bezel and defines the elongate lighted segments as well as a circuit board 38 shown in FIG. 9. This circuit board has five dual color LED's 40, 42, 44, 46 and 48, which cooperate with the lens member and form the first elongate lighted segment 20. The three dual colored LED's 50, 52 and 54 cooperate with the lens body and form the elongate lighted segment 22 and the single dual color LED 60 forms the smallest elongate lighted segment 24. This circuit board is provided behind the lens body 78 and is secured to the bezel as shown in FIG. 13.

Figure 10:
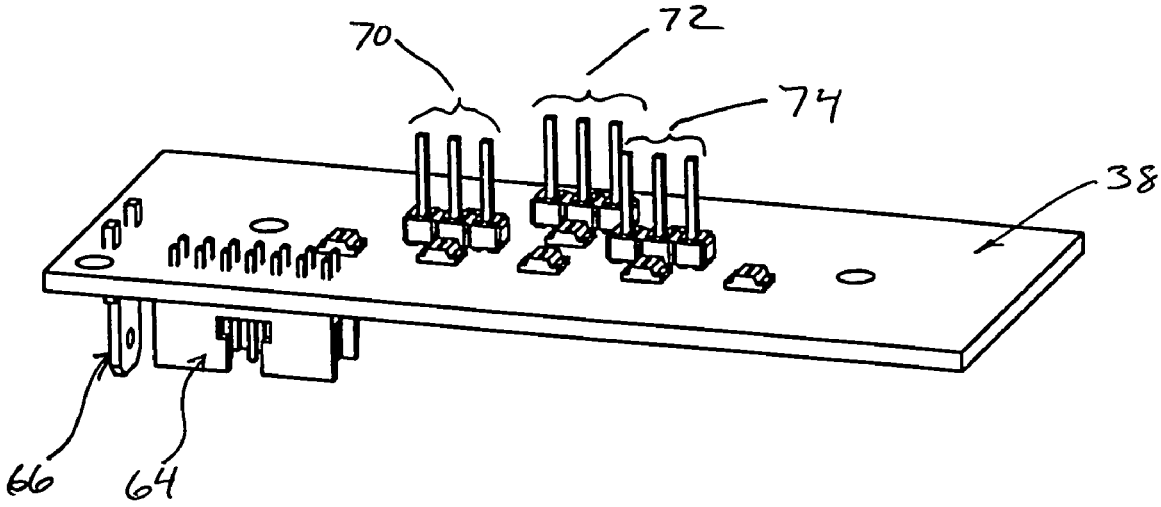
FIG. 10 is a perspective view of the circuit board shown in FIG. 9 and additionally, showing grounding pins used to protect the circuit board from deliberate shock.

In FIG. 10, the circuit board 38 is also shown with a series of grounding pins 70, 72 and 74 which project through the lens body to the front face of the bezel and provides a ground path through the grounding connector 66. This effectively protects the circuit board 38 and the LED's from deliberate electrical attack. It is known to attempt to deliberately damage a validator by producing an electrical shock on the front face of the bezel.

The circuit board as shown in FIGS. 9 and 10 includes a multi pin connector 64 for connecting to a processor associated with the validator. Preferably, the sequence for controlling the ON/OFF characteristics of the particular LED's is a small program operated by the processor of the validator.

Figure 11:
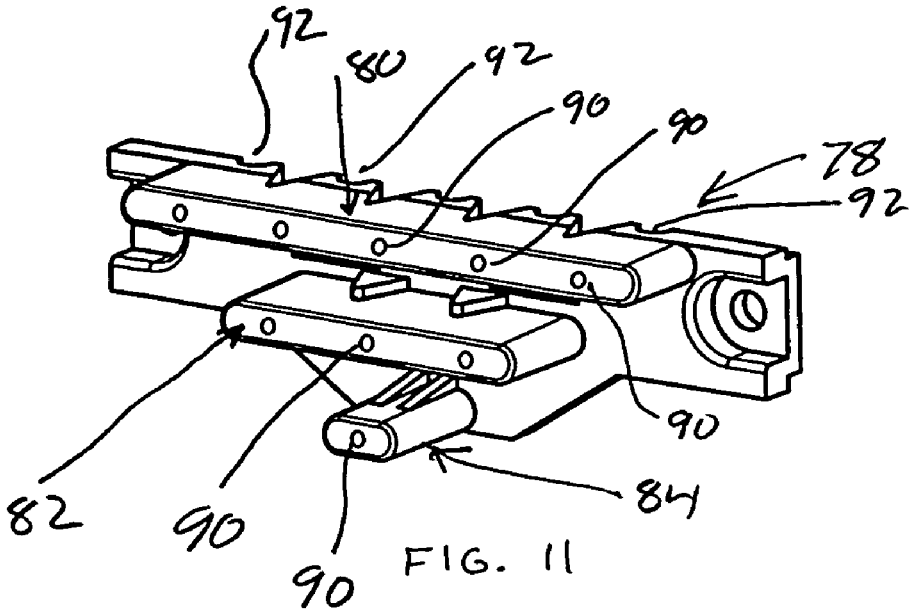
FIG. 11 is a perspective view of the lens body showing the various lens segments.
Figure 12:
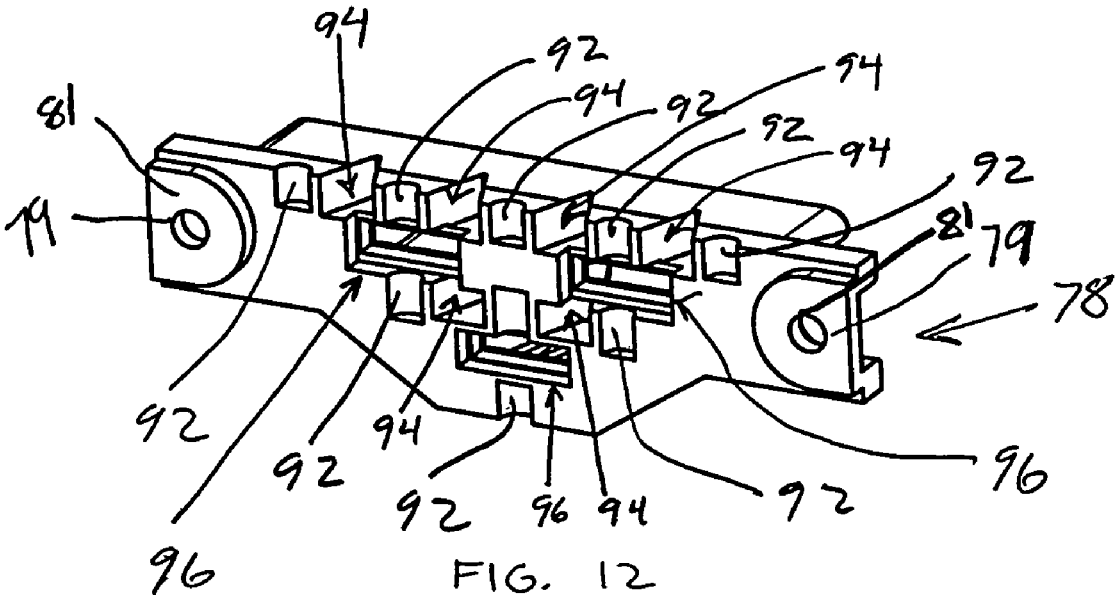
FIG. 12 is a rear perspective view of the lens body.

The lens body 78 shown in FIGS. 11 and 12 includes the elongate lens segment 80, a shorter elongate lens segment 82, and the smallest lens segment 84. These form the V-shaped pattern that collectively point towards the banknote slot 6. These lens segments extend through the front face of the bezel and are generally planar with the angled transition surface 30 of the bezel. As this surface is angled, the lens segments are of different depths to accommodate the angled surface and the lens body is secured on perpendicular mounts. The top surface of each lens segment is preferably textured to diffuse the light emitted therethrough.

The lens body 78 is designed to specifically cooperate with the various LED's provided on the circuit board. The elongate lens segment 80 includes five centering dots 90 which are generally aligned with the LED receiving recesses 92 associated with this lens segment. Between each adjacent lens recess 92 is a V-shaped recess 96. The V-shaped recess is preferably spaced from adjacent lens recesses 92. These V-shaped recesses provide angled surfaces which form lighted bar segments extending vertically across the particular lens segment. This effectively produces points of high illumination in the dot 90, as well as two bar segments extending across the lens between each adjacent centering dot 90. This provides a simple effect for producing a desirable pattern across the lens segment. This is also true with respect to the shorter lens segment 82. The lens segment 90, as can be appreciated from the rear view of FIG. 12, only includes the recessed LED recess 92 due to its short length.

It can also be seen that the lens body 78 includes three ports shown as 96 which allow the grounding pins 70, 72 and 74 to extend through the lens body to the back face of the bezel 4.

The lens body 78 includes two securing ports 79 that align with securing ports 41 of the circuit board 38 and allows securement of these components to the rear face of the bezel 4. It can be seen that the rear face of the lens body 78 and the securing ports 75 include a projecting surface 81 which partially separates the circuit board from the rear face of the lens body. These surfaces allow for the positioning of the various LED's in the lens body.

In FIG. 13, the cross section through the bezel and the through the elongate lighted segment 20 illustrates the alignment of LED's 40, 42, 44, 46 and 48 in the LED receiving recesses 92 of the lens body 78. To produce a bright spot on the front face of the bezel, the angled surfaces of the V-shaped notches 96 produce two bar segments standing across the bezel between adjacent centering dots 90. This produces a desirable change in illumination level along the length of each of the lens segments 80, 82 and 84 in a simple cost effective manner.

Each of the LED's shown on the circuit board 38 is in fact two different colored LED's. The preferred LED produces a bright blue light and the lens body is also preferably of a translucent blue material.

The lighted blue segments of the bezel are in contrast to the normal red and green colors that may be directly associated with the banknote slot. The V-shape configuration of the bar segments and the spacing thereof from the banknote slot produce a striking visual effect that is difficult to ignore. The blue segment and the particular sequencing of lighting of the individual segments are immediately noticed, however, it is not offensive. The sequence is rhythmic and somewhat soothing and has almost a wave action. The bezel has been found to complement the marketing of the visual presentation of the point of sale system and promotes the initial step required to successfully complete the sale. The different lengths of the bar segments and the V-shaped configuration provide directional information to a user and the location of this information in a transitional segment is also desirable. The area about the banknote slot is free to allow for other functionalities such as increased finger area or desirable configuration of the banknote slot.

It is also possible to easily configure or change the lighting sequence of the bezel. For example, the bezel can easily be changed to produce colors more suitable for the particular point of sale system in which it is to be installed. In addition, the lens body allows for further promotion by easily changing the color thereof and also changing any pattern provided on the front surface. Preferably, the front surface has a pebbled or etched type surface to further diffuse the light but the surface could be configured with appropriate advertising patterns including design, trademarks, work trademarks, etc.

Furthermore, a series of different colors could be used or the sequence could be such that it uses one colored LED for a number of sequences followed by a change in the color for a different number of sequences. It is also possible to change the color within a sequence or change the color of LED's within a segment. Therefore, the bezel allows for a simple arrangement that allows a purchaser to specify a bezel that is appropriate for the particular application. The use of LED's on a separate circuit board allows for convenience replacement of one circuit board with a more appropriate circuit board and thus simplifies manufacturing. The validators can be manufactured and bezels can easily be replaced to meet any custom specs that may be required.

The particular sequence used for lighting of the three segments takes less than two seconds and preferably, each step is of a duration of approximately 0.125 milliseconds.

The particular embodiment described has three lighted segments but additional lighted segments can be used. The elongate bar pattern with each bar pattern being generally parallel to the banknote slot is preferred but other patterns are also possible. For example, the line segments might be slightly curved or the line segments in fact could have a V-type configuration. Therefore, other shapes for the lighted segments are quite possible. It is desirable to have some spacing between these lighted segments and that the segments be illuminated in a particular sequence.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In a banknote validator, a bezel having a front face with a banknote slot for receiving banknotes and at least three lighted segments of different lengths positioned to one side of said banknote slot; and a circuit operative to repeatedly turn on and off said lighted segments at a rate and in a repeating sequence to provide a visual direction towards said banknote slot; and wherein said at least three lighted segments collectively form a V shaped configuration pointed towards said banknote slot; and wherein said circuit includes a circuit board and each lighted segment includes a lens and at least one LED provided on said circuit board positioned within said bezel adjacent to said lens, said lens for each LED cooperating to define at least 3 separate spaced areas of higher illumination within the lighted segment.

2. In a banknote validator as claimed in claim 1, wherein said lighted segments are at different spacings from a longitudinal axis of said banknote slot.

3. In a banknote validator as claimed in claim 2, wherein said lighted segments are elongate.

4. In a banknote validator as claimed in claim 2, wherein said lighted segments are elongate bar members having a parallel orientation relative to said banknote slot.

5. In a banknote validator as claimed in claim 1, wherein said lighted segments cooperate to form a moving visual arrow effect orientated towards said banknote slot.

6. In a banknote validator, a bezel having a front face with a banknote slot for receiving banknotes and at least three lighted segments of different lengths positioned to one side of said banknote slot; and a circuit operative to repeatedly turn on and off said lighted segments in a sequence to provide a visual direction towards said banknote slot; and wherein said circuit includes a circuit board and each lighted segment includes a lens and at least one LED provided on said circuit board positioned within said bezel and adjacent to said lens, said lens for each LED cooperating to define at least 3 separate spaced areas of higher illumination within the lighted segment.

7. In a banknote validator as claimed in claim 6 wherein each lens is a colored lens.

8. In a banknote validator as claimed in claim 6 including a single component that includes each lens.

9. In a banknote validator as claimed in claim 6 wherein said at least 3 separate spaced areas of higher illumination include at least two bar portions extending across said lighted segment.

10. In a banknote validator as claimed in claim 6 wherein said lighted segments form 3 lighted bar portions at different spacings from said banknote slot, and wherein said sequence lights a first bar portion furthest from said banknote slot followed by lighting of a second bar portion immediately adjacent said first bar portion and closer to said banknote slot, followed by lighting of a third bar portion adjacent to said second bar portion and closest to said banknote slot followed by turning off said third bar portion, followed by turning off said second bar portion, followed by turning off said third bar portion.

11. In a banknote validator as claimed in claim 10 wherein said sequence is constantly repeated in an attract mode.

12. In a banknote validator as claimed in claim 10 wherein said sequence has a duration of less than two seconds.

13. In a banknote validator as claimed in claim 12 wherein each step to light or turn off a bar portion has a duration of less than 150 milliseconds.

14. In a banknote validator as claimed in claim 10 wherein said circuit board includes 5 aligned LED's positioned to light said first bar portion, 3 aligned LED's positioned to light said second bar portion, and a single LED for lighting said third barportion.

15. In a banknote validator as claimed in claim 14 wherein each LED is two LEDs of different colors.

16. In a banknote validator as claimed in claim 6 wherein said lighted segments when turned on illuminate the length of the lighted segment.

17. In a banknote validator as claimed in claim 6 wherein said sequence to repeatedly turn on and off said lighted segments has a repeating time duration of less than two seconds.

18. In a banknote validator as claimed in claim 6 wherein a time duration between the lighting of each lighted segment is less than 200 milliseconds.

19. In a banknote validator as claimed in claim 18 wherein said sequence includes progressively lighting each lighted segment until all lighted segments are on.

* * * * *